US007284929B2

(12) United States Patent
Schwenninger

(10) Patent No.: US 7,284,929 B2
(45) Date of Patent: Oct. 23, 2007

(54) PAVER AND METHOD FOR SIMULTANEOUSLY CASTING SEVERAL PAVING MATERIAL LAYERS

(75) Inventor: Dieter Schwenninger, Hockenheim (DE)

(73) Assignee: Joseph Vogele AG, Mannheim (DE)

( * ) Notice: Subject to any disclaimer, the term of this patent is extended or adjusted under 35 U.S.C. 154(b) by 110 days.

(21) Appl. No.: 11/090,319

(22) Filed: Mar. 25, 2005

(65) Prior Publication Data

US 2005/0220540 A1 Oct. 6, 2005

(30) Foreign Application Priority Data

Apr. 2, 2004 (DE) ..... 10 2004 016 419

(51) Int. Cl.
*E01C 19/22* (2006.01)
*E01C 19/12* (2006.01)
*E01C 19/00* (2006.01)
*E01C 19/38* (2006.01)

(52) U.S. Cl. ..... 404/102; 404/82; 404/83; 404/101; 404/108; 404/113; 404/118

(58) Field of Classification Search ..... 404/82, 404/102, 83, 101, 108, 113, 118
See application file for complete search history.

(56) References Cited

U.S. PATENT DOCUMENTS 1,982,387 A * 11/1934 Heltzel ..... 404/75
4,101,622 A * 7/1978 Wells et al. ..... 264/251
4,549,364 A * 10/1985 O'Connor ..... 37/197
4,930,935 A * 6/1990 Quenzi et al. ..... 404/75
5,735,634 A 4/1998 Ulrich et al.
5,846,022 A * 12/1998 Grundl ..... 404/101
6,089,785 A * 7/2000 Bergman ..... 404/110
6,106,141 A * 8/2000 Bruun ..... 366/68
6,193,438 B1 * 2/2001 Heims ..... 404/110
6,514,007 B2 * 2/2003 Richter ..... 404/101

FOREIGN PATENT DOCUMENTS

DE 3114049 10/1982
DE 3209989 9/1983
DE 19935598 2/2001

* cited by examiner

*Primary Examiner*—Raymond W Addie
(74) *Attorney, Agent, or Firm*—Darby & Darby

(57) ABSTRACT

At least two paving screeds B1, B2 which are distant in operation running direction R are supported at a chassis 1 of a paver F. The paver F is designed for simultaneously casting several paving material layers L1, L2 on top of each other on a plane P. Each paving screed B1, B2 is provided with a compaction assembly. One paving screed B1 for casting a lower layer L1 is provided at a front end section of the chassis 1 and has the compaction assembly 13, 14 for generating a degree of compaction in the lower layer L1 which suffices to withstand the direct contact of the undercarriage 2. At least one further paving screed B2 for casting an upper layer L2 is arranged behind the undercarriage 2. According to the method to be carried out with the paver F the lower layer which is cast and compacted in front of the undercarriage allows to run the undercarriage 2 on the lower layer while the upper layer L2 is cast and compacted behind the undercarriage 2.

9 Claims, 2 Drawing Sheets

3
4
F
B1
18
17
5
21
16
15
R
6
1
12
B2
9
10
V1
14
11
13
19
L1
2
8
7
V2
11
L2
13
P

PAVER AND METHOD FOR SIMULTANEOUSLY CASTING SEVERAL PAVING MATERIAL LAYERS

FIELD OF THE INVENTION

The invention relates to a paver and a method of paving for casting multiple paving layers.

BACKGROUND OF THE INVENTION

A known paver for casting several layers of concrete comprises at least two high compaction concrete paving screeds which are located behind each other, are towed floatingly and are linked by separate towing bars to the chassis. Both paving screeds are situated in operation travelling direction behind the undercarriage. Two hoppers each for one sort of a concrete paving material are provided at the chassis from which hoppers separate longitudinal conveyors extend to the lateral distribution assemblies arranged in front of the respective paving screed. The undercarriage travels on the plane. The first paving screed casts and compacts the lower layer before an upper layer is immediately subsequently cast and compaction thereon. The structure of the paver is relatively complicated. The paver has a large working height. It thus is necessary to install upper paver components such that they can be removed for transport purposes. The weight of the paver is high, in particular in the rear region of the chassis such that in some cases rear cantilevering supporting outriggers equipped with running wheels are needed.

Furthermore, a paver for casting two asphalt layers on top of each other is known from the BAUMA 2004 exhibition (compact asphalt paver) which comprises two high compaction asphalt paving screeds which are linked by separate towing bars to the chassis and operate behind each other and behind the undercarriage. A second removable hopper is provided on top of a hopper which is integrated into the chassis. Separate longitudinal conveyers extend from both hoppers to lateral distribution assemblies in front of the respective paving screeds. The known paver is of complicated construction, very heavy, and has an enormous height. The rear chassis end is additionally supported on the plane by rear cantilevering outriggers equipped with ground wheels.

When casting a fixed trackway, e.g. a railway embankment, with one paver having two floatingly towed high compaction paving screeds of certain working widths e.g. two concrete layers are cast on top of each other each of which may have a thickness up to about 30 cm. This is done e.g. because a single layer of about 60 cm of concrete may be cast but could not be compacted sufficiently in the lower region. The undercarriage travels on the plane. Among other things, the paver is structurally complicated and heavy, because all of the paving material has to be fed longitudinally through the paver and has to be transferred to the towed paving screeds.

BRIEF DESCRIPTION OF THE INVENTION

Of further interest are: DE 295 10 058 U, DE 199 35 598 A.

It is an object of the invention to provide a paver of the kind as disclosed which is structurally simple, compact and lightweight, and to provide a method which allows to simultaneously cast several layers in a simpler fashion.

Feeding the one paving screed which casts a lower layer in front of the undercarriage only needs low apparatus efforts and is simpler in terms of the method than feeding is in the known pavers. With the help of the simplified feeding a simple and fair cost structure of the paver is achieved, offering the advantage of lower height and lower weight. The existing prejudice against a paver travelling on a freshly cast layer surprisingly has proven to be a false estimation, because modern paving screeds allow to generate in most of the usual paving material sorts a degree of compaction which withstands the mechanical load of the travelling undercarriage without any problems. The paving screed placed in the front improves the weight distribution of the paver and does not significantly hinder the conventional feeding by a dump truck or a feeder travelling ahead. The paving screed supported behind the undercarriage at the chassis then casts a respective upper layer. The paver can not only be used for concrete paving material but also for asphalt paving material or even for combinations of these paving materials. Even other paving materials can be processed with the paver provided that the respective paving material allows to be compacted sufficiently. Expediently the same sort of paving material is processed by the front and rear paving screeds because then the feeding is simpler. Alternatively, however, differing paving materials could be cast by the front and rear paving screeds.

In terms of the method it is expedient when the lower layer is cast and compacted with the help of direct feeding to the paving screed placed in front of the undercarriage while each upper layer first is cast and compacted behind the undercarriage on top of the compacted lowest layer.

Expediently the compacted devices of the paving screeds are high compaction devices which allow to generate at least a degree of compaction which can tolerate the undercarriage running thereon without problems, or which in some cases even is higher than would be needed for paver travelling with the total weight on the freshly compacted layer. In connection therewith the contents of DE C 31 14 049 and DE C 32 09 989 are incorporated here.

In a preferred embodiment the front paving screed is directly fixedly supported at the chassis in a selectively adjusted height and/or with a selectively adjusted blade angle. In this case a significant part of the total weight of the paver resting on the chassis can be used to easily reach a high degree of compaction. The thickness of the layer is determined by the adjustments of the paving screed in relation to the chassis.

In another embodiment it may be expedient to support the front paving screed at the chassis such that it is floatingly towed or pushed. In this case the total paver weight resting on the chassis cannot be used for the compaction, however, modern high compaction devices (DE C 31 14 049; DE C 32 09 989) produce without extra load sufficiently high degrees of compaction by means of the frequency and the strength of the compacting pulses.

In order not to complicate feeding into the hopper it is expedient when the front paving screed is placed in front of the chassis front end but at least partly below the filling area of the hopper.

The front paving screed should comprise at least one high compaction bar and compaction bar drives, e.g. of hydraulic nature, and at least one tamper bar and, preferably hydraulic, tamper bar drives. These two component groups allow in conjunction to produce sufficiently high degrees of compaction and a well-defined evenness of the cast and compacted lower layer.

Particularly expediently the front paving screed is comprised of a screed body of a base screed part of a standardised paving screed or of a standardised extendable paving screed (i.e. of a base screed part without extension parts). The screed body has small height and is not very deep in travelling direction such that the feeding conditions for the hopper are hardly negatively affected. The screed body used as the front paving screed corresponds in this case e.g. to a downsized base screed part of a standard paving screed or of a standard extendable paving screed, i.e. it does not need to be a specially manufactured new paving screed. Although the front paving screed could uniformly cast the lower layer on the plane out of a sufficiently large paving material heap, thanks to the strong pushing force of the undercarriage, it could be expedient to provide at least one lateral distribution assembly in front of the front paving screed, e.g. a lateral auger arrangement or a lateral distribution blade assembly. A lateral distribution blade or several lateral distribution blades save weight, only need a simple drive, and result in a small depth in working direction.

When the front paving screed is directly supported at the chassis it expediently can be pivotally adjusted about a lateral axis and can be fixed in selective pivotal positions, preferably by means of at least one adjustment drive arranged between the paving screed and the chassis. Furthermore, the paving screed should be adjustable and fixable in height relative to the lateral axis and relative to the chassis. The reaction forces resulting from casting the paving material on the plane directly are taken-up from the heavy chassis on which the total weight of the paver is resting.

Expediently, the front paving screed has a working width larger than the track width of the undercarriage, and corresponding to the working width of the paving screeds provided behind the undercarriage. In the case that e.g. the working width of a screed body of a base screed part should be too small compared to the desired working width, as usual, broadening parts can be mounted on the sides of the screed body.

Alternatively, the front paving screed could be an extendable paving screed having extension parts. This embodiment is expedient for casting layers of asphalt paving material. Structural equipment can be simple when the compaction bar drives and/or the tamper bar drives are directly connected to the power supply of compaction bar drives and/or tamper bar drives for one of the paving screeds provided behind the undercarriage. This does not exclude providing the front paving screed with its own power supply and power control. Although the front paving screed does not necessarily need vibrators, even vibrators for the smoothing plate could be installed, if desirable.

Feeding the respective paving material can be simplified if a saddleback roof-shaped pouring surface arrangement is provided above the front paving screed which arrangement both extends forwards in front of the front paving screed and rearwards to the filling area of the hopper. The paving material transferred from a dump truck or a feeder can be lead by the pouring surface arrangement into the hopper and at the same time to the plane region in front of the front paving screed to build a heap of paving material there. Preferably, the pouring surface arrangement is provided with a gathering snout which extends downwardly in front of the front paving screed and at which the lateral distribution assembly could be mounted. The gathering snout enhances the lateral distribution of the paving material and prevents too strong a contamination of the front paving screed. The pouring surfaces could be sheet metal parts and/or rubber plates. In a simple embodiment a rubber hood is used which is carried by the chassis.

In a preferred embodiment having a front paving screed supported fixedly at the chassis lateral tubes of a tube frame defining the lateral axis of the front paving screed are hung into outriggers provided at the chassis or at a lateral beam of the chassis, respectively. The height adjustment device is provided between the lateral tubes and the outriggers in order to allow to adjust and fix the blade angle of the paving screed. Furthermore, the adjustment drives for adjusting the height position of the lateral axis or of the paving screed, respectively, are arranged between the paving screed and the chassis lateral beam. The arrangement results in a well defined transfer of reaction forces into the chassis.

Expediently the front paving screed and accessory components define a sub-structure group which is removable from the paver. A paver designed for casting a single layer can be retrofitted with only small modifications in the front end region of the chassis without problems and with the sub-structure group to a paver for then casting several layers. For example, only the dump truck wheels pushing rollers need to be dismantled before the front paving screed is mounted instead.

In an expedient embodiment the paver is equipped with a caterpillar undercarriage, the front high compaction paving screed being located in front of the caterpillar undercarriage, with a further floatingly towed high compaction paving screed towed behind the caterpillar undercarriage, all for casting a firm trackway, e.g. a railway embankment, with a width up to about 3.0 m. Both paving screeds have the respectively needed working widths, which even may be equal among each other. Both paving screeds are aligned with one another in longitudinal direction of the paver. Expediently, both paving screeds even are base screed parts of standardised paving screeds or standardised extendable paving screeds, respectively.

Expediently, the method is carried out such that a firm trackway, e.g. a railway embankment, is cast of two concrete layers cast one above each other at a width of about 3.0 m.

BRIEF DESCRIPTION OF THE DRAWINGS

Embodiments of the invention will be explained with the help of the drawings. In the drawings is.

DETAILED DESCRIPTION OF THE INVENTION

Figure 1:
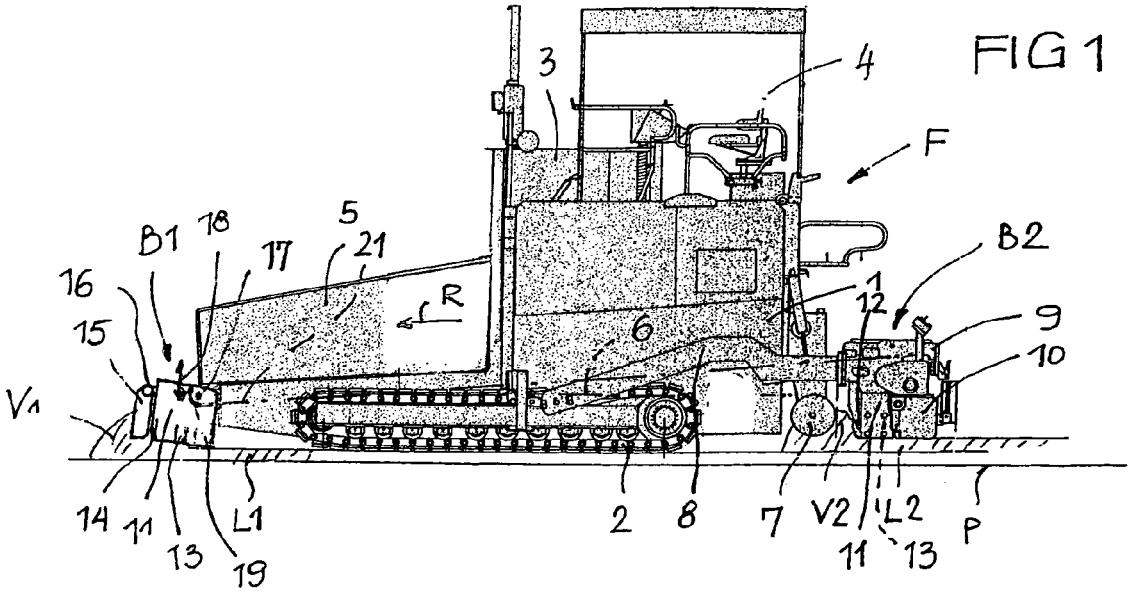
FIG. 1 a schematic side view of a paver prepared for casting several layers, and FIG. 2 an enlarged illustration of a front chassis end region of the paver of FIG. 1.

A paver F in FIG. 1 serves to cast at the same time several paving material layers L1, L2 which lie on top of each other, particularly from concrete and/or asphalt, on a plane P which has been subjected to a preparatory treatment. The paver F has a chassis 1 on an undercarriage 2, in this case e.g. a caterpillar undercarriage, which is driven from a primary drive source 3 in operation running direction R. An operator's stand 4 is provided behind the primary driving source 3. A paving material hopper 5 of paving material is placed in front of the primary driving source 3 at or within the chassis 1. A longitudinal conveyor 6 indicated by dotted lines extends from the paving material hopper 5 to the rear end of the chassis 1 and to a lateral distribution assembly 7 which is provided on the chassis 1, e.g. a lateral auger assembly. A paving screed B2 which is placed behind the lateral distribution device 7 is floatingly towed by towing bars 8 which are linked to the sides of the chassis 1.

The rear paving screed B2 has a base screed part 9 with a lower screed body 11, and, in some cases, even sidewardly extendable extension screed parts 10. At least the base screed part 9 is equipped with at least one tamper bar 13 which e.g. is driven by not shown hydraulic motors and with one or several compacting bars 12 having, e.g. hydraulic, swelling force drives (not shown) and rotary valves, altogether constituting a compaction device of the paving screed B2, e.g. corresponding to DE C 31 14 049 or DE C 32 09 989.

At a frontal end section of the chassis 1 seen in the operation running direction a front paving screed B1 is provided such that it can cast and compact the lower layer L1 in front of the undercarriage 2 from a paving material heap V1. The paving screed B1 as well is equipped with a compaction device, e.g. with at least one tamper bar 13 with e.g. a hydraulic drive and at least one compaction bar 14 with e.g. hydraulic drives. Furthermore, a frontally placed lateral distribution assembly 15, 16 is associated to the front paving screed B1, e.g. a lateral hydraulic cylinder 16 driving at least one distribution blade 15 back and forth laterally to the operation running direction R, in order to uniformly distribute the paving material from the paving material heap V1. Not shown side plates can be, as conventional, provided at the paving screed B1.

The blade angle of the paving screed B1 can be adjusted about a lateral axis 17, in particular by adjustment drives indicated by a double arrow 19. Furthermore, the paving screed B1 is adjustable in height direction (double arrow 18) by a not shown height adjustment device. The front paving screed B1 can be fixed in the respective selected pivotal position (blade angle) or height position in relation to the chassis 1 and is then directly fixedly supported at the chassis 1.

In the embodiment shown, e.g. the hydraulic drives of the compaction bar 14 or the tamper bar 13 in the front paving screed B1 are connected by supply strands 21 with a power supply of the tamper bar 13 and the compaction bar 14 of the rear paving screed B2 placed behind the undercarriage 2, such that the front paving screed B1 does do not need its own power control assemblies like rotary valves or flow regulating valves. Alternatively, such power control devices as well could be contained in the one front paving screed B1 and then could be connected with the hydraulic supply of the paver.

The compaction assembly of each paving screed B1, B2 expediently is a high compaction assembly such that the lower layer L1 can also be cast by the paving screed B1 in front of the undercarriage 2 with a degree of compaction which then immediately can carry the undercarriage 2 with the total weight of the paver F, or which degree of compaction even is higher than needed for that.

The paving material for the rear paving screed B2 is filled e.g. by a dump truck or a feeder into the hopper 5. The paving material for the front paving screed B1 e.g. is thrown by the same truck or feeder on the plane P in front of the paving screed B1 to form the heap V1. The longitudinal conveyor 6 forms a paving material heap V2 in front of the lateral distribution assembly 7 of the rear paving screed B2 such that the rear paving screed B2 is capable of casting the upper layer L2 out of the heap V2 and compacting the upper layer during the casting process.

During operation of the paver F in FIG. 1 the lower layer L1 is cast by the front paving screed B1 and is compacted so far that the undercarriage 2 can run without problems on the compacted lowest layer L1 before the upper layer L2 is cast and compacted behind the undercarriage by the rear paving screed B2.

Both paving screeds B1, B2 have the same working width which e.g. is broader than the track width of the undercarriage 2. The same paving material sort can be processed by both paving screeds B1, B2. Alternatively, different paving material sorts can be processed, however, then care has to be taken that the feeding processes to the front paving screed B1 and to the hopper 5 are carried out separately. The thicknesses of the layers L1, L2 may be equal or may differ from each other.

Expediently the front paving screed B1 is a screed body 11 of the base screed part 9 of a standard paving screed. The extendable screed parts indicated in FIG. 1 at the rear paving screed B2 may be present or may be omitted at the front paving screed B1. When the extendable screed parts are present at the rear paving screed, they will remain retracted to have a certain working width corresponding to the working width of the front paving screed B1.

Alternatively, both the front paving screed B1 and the rear paving screed B2 could be designed as extendable paving screeds having sidewardly extendable screed parts.

In FIG. 1 the front paving screed B1 is fixedly supported at the chassis 1 such that the total weight of the paver F resting on the chassis 1 assists the compaction of the lower layer L1.

Alternatively (not shown), however, the front paving screed B1 even could be towed or pushed floatingly, and in particular with pushing bars similar to the tow bars 6. In this case the blade angle of the front paving screed B1 fixed to the pushing bars could be adjusted by height adjustments of the linking points of the pushing bars at the chassis 1.

Figure 2:
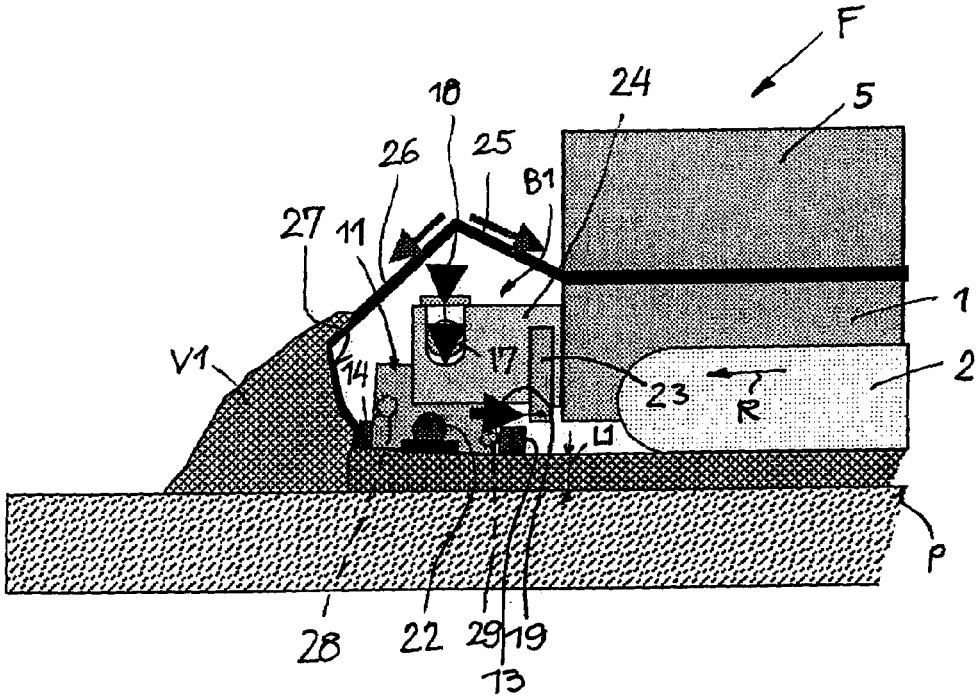

FIG. 2 schematically indicates a part of a paver F which can be used as a not limiting embodiment in order to produce a firm trackway, e.g. a railway embankment, of two concrete layers, e.g. with a width up to 3.0 m. For this work the (not shown) rear paving screed B2 of the paver in FIG. 2 may be a base screed part essentially like the base screed part 9, 11 in FIG. 1 (without extendable screed parts) with a working width of 3.0 m or with a base width of 2.5 m and two sidewardly placed broadening parts of 25 cm each, and with a compaction assembly (high compaction assembly). The front paving screed B1 may be a screed body 11 of a base screed part 9 only.

The side outriggers 24 are fixed at a conventional chassis lateral beam 25 and protrude forwards. The outriggers 24 contain in pockets lateral tubes of a tube frame of the paving screed B1. The lateral tubes define the pivot axis 17. The height adjustment device 18 engages at each side at the lateral tubes. The adjustment drives 19 are placed between the paving screed B1 and the chassis lateral beam 23, e.g. in the form of hydraulic cylinders or turnbuckles or the like, in order to allow to adjust and fix the blade angle. Reference numeral 28 indicates e.g. hydraulic drives for the tamper bar 13; reference numeral 29 indicates e.g. hydraulic drives for both compaction bars 14. Those drives are connected via supply strands 21 indicated in FIG. 1 either to the power control of the corresponding components in the rear paving screed B1 (flow regulation valve, rotary valve), or (not shown) are equipped with their own power control devices which then are connected to the hydraulic system of the paver, respectively. Additionally, a vibrator 22 for the lower smoothing plate of the screed part 11 is indicated which may be provided optionally.

A pouring surface assembly with the shape of a saddle-back roof having pouring sheet metal surfaces and/or rubber plates 25, 26 is shown above the front paving screed B1. The assembly forms a downwardly sloped ramp into the filling region of the hopper 5 (for the paving material for the rear paving screed B2) and a ramp (for the paving material for the front paving screed B1) inclined forwardly in operating running direction R. A downwardly extending gathering snout 27 (made of sheet metal or rubber) continues the frontmost pouring sheet metal surface. The snout 27 covers the tamper bar 14 at the front side. The lateral distribution assembly indicated in FIG. 1, e.g. consisting of the hydraulic cylinder 16 with the distributing blades 15, is not shown in FIG. 2. However, such an assembly could be provided in front of the snout 27 in order to sidewardly distribute the heap V1 such that the front paving screed B1 receives sufficient paving material forecasting the lowest layer L1 over the full working width. The pouring surface assembly 25, 26 could be a hood of semi-rigid rubber material including the gathering snout 27 and could cover the paving screed B1, could control the feeding flow of the paving material, and could be removably fixed at suitable locations of the chassis 1.

During operation of the respective paving screed B1, B2 the tamper bar 13 pre-compacts and evens before the at least one compaction bar 14 produces the final degree of compaction high enough to prevent damage in the lowest layer L1 when the undercarriage 2 travels on the compacted lowest layer L1. The compacting bars 14 are actuated by swelling force pulses in order to uniformly compact the lower layer L1 down to the plane P without a significant beating action. Incidentally, the plane P is pre-treated in order to be substantially even and free of larger objects.

Prior to the start of the casting operation the undercarriage 2 is moved on laid down planks or on ramps which slope upwardly in operation travelling direction R. Then the blade angle and the height position of the front paving screed B1 are adjusted corresponding to the thickness of the lower layer L1. The rear paving screed B2 is adjusted in analogous fashion.

The following alternatives could be provided:

In case that more than two layers are to be cast more than one paving screed B2, each expediently having its own towing bars 6, could be provided behind the undercarriage 2. In case that differing paving material sorts are to be processed more than the one hopper 5 could be provided. In this case the hopper for the front paving screed does not need a longitudinal conveyor but e.g. pours the paving material directly in front of the paving screed on the plane by gravity and through controlled dosing flaps or the like. In some cases heap touching feelers could be used to regulate a sufficiently large heap in front of the paving screed. Finally, the front paving screed B1 could be a special one adapted to the particular casting conditions and feeding relationships in front of the paver.

The front paving screed B1 with its accessory components expediently is a removable sub-structure of the paver F. The paver is slightly modified in comparison to a standard paver e.g. having truck wheels pushing rollers at the front The paver is retrofitted from a condition for casting a single layer behind the undercarriage or for casting several layers behind the undercarriage only into a condition for now casting several layers in front of and behind the undercarriage 2.

The pouring surface assembly 25, 26 in FIG. 2 expediently is provided for feeding one paving material sort from a dump truck or from a feeder to both paving screeds B1, B2. The dump truck or the feeder then does not only feed into the hopper 5 but also forms the heap V1. In case that differing paving material sorts are processed then e.g. two feeders which are offset sidewardly in relation to each other could feed into the hopper 5 and in front of the front paving screed B1. A further possibility is to load the hopper 5 from the side and to form the heap V1 from the front side.

The core of the invention is to provide at a feeder F at the chassis in front of the undercarriage 2 (caterpillar undercarriage or wheeled undercarriage) a paving screed B1 having a compaction device for casting a lower layer and for compacting the lower layer so strongly that the undercarriage can travel on the cast lower layer without damaging it before in some cases a further upper layer is cast behind the undercarriage.

The invention claimed is:

1. A paver for casting at least two layers of material on a surface, one layer on top of the other layer, comprising:

a chassis carried by an undercarriage, a first paving screed on the front end of said chassis that has at least one of a selectively adjustable height or a selectively adjustable blade angle for casting a lower layer of material from material previously deposited adjacent to the surface;

a second paving screed on the rear end of said chassis, said second paving screed separated from said first paving screed by a distance in the casting running direction of said undercarriage for casting a second layer of material on the lower cast layer cast by said first paving screed, said second paving screed having a screed body of a base screed part or of an extendable paving screed having sidewardly extendable screed parts.

a compaction assembly for each said first and second paving screed for generating a predetermined degree of compaction for the material deposited by the respective screed, said compacting assembly of said first paving screed comprising a high compaction assembly with at least one high compaction bar with compaction bar drives and at least one tamper bar with tamper bar drives;

a hopper on said chassis into which the material to be deposited by said second screed is placed, and a conveyor between said hopper and said second paving screed for carrying the material from said hopper to said second paving screed.

2. Paver as in claim 1, wherein said first paving screed is placed in front of the front section of said chassis and at least partly below a filling area of said hopper.

3. Paver as in claim 1, further comprising a lateral distribution auger or a lateral distribution blade as a lateral distribution assembly in front of said second paving screed.

4. Paver as in claim 1, wherein said second paving screed is pivotable about a lateral axis by at least one adjustment drive provided between said second paving screed and the front end section of said chassis, wherein said second paving screed is adjustable in height and is fixed in the adjusted height and pivoted position in relation to said chassis and together with the lateral axis or in relation to the lateral axis.

5. Paver as in claim 1, wherein said at least one said compaction bar drives or said at least one tamper bar drives of said first paving screed comprises hydraulic devices connected via supply lines directly to a power supply of said at least one compaction bar drives or said at least one tamper bar drives of said second paving screed.

6. Paver as in claim 1, wherein said first paving screed is hung into outriggers provided at the chassis or at a chassis lateral beam arranged at the front end section of said chassis, respectively, via a lateral tube defining a lateral axis, and a height adjustment assembly between either the lateral tube and the outriggers, or between said first paving screed and the chassis lateral beam.

7. Paver as in claim 1, wherein said first paving screed defines a sub-structure group which is removably mounted at the front end section of said chassis.

8. Paver as in claim 1, further comprising:

a pouring surface assembly having the shape of a saddle-back roof provided at the front end section of said chassis above said first paving screed and said pouring surface assembly comprising a gather snout extending downwardly in front of said second paving screed, and a lateral distribution assembly arranged in front of said gathering snout.

9. Paver as in claim 8 wherein said pouring surface assembly comprises sheet metal parts and/or rubber plates.

* * * * *